United States Patent [19]

Stromeyer

[11] Patent Number: 5,002,081

[45] Date of Patent: Mar. 26, 1991

[54] UMBRELLA WITH SUSPENDED CANOPY

[75] Inventor: Markus Stromeyer, Pfyn, Switzerland

[73] Assignee: L. Stromeyer & Co., Kreuzlingen, Switzerland

[21] Appl. No.: 416,998

[22] Filed: Oct. 4, 1989

[30] Foreign Application Priority Data

Dec. 22, 1988 [CH] Switzerland ..... 4753/88

[51] Int. Cl.[5] ..... A45B 11/00

[52] U.S. Cl. ..... 135/21; 135/90; 135/20 A; 248/342; 248/288.5

[58] Field of Search ..... 135/90, 98, 114, 20 A, 135/21, DIG. 9; 248/342-344, 288.3, 288.5

[56] References Cited

U.S. PATENT DOCUMENTS

| | | | |
|---|---|---|---|
| 200,945 | 3/1878 | Smith | 135/21 |
| 2,199,915 | 5/1940 | Howard | 135/90 |
| 2,749,074 | 6/1956 | Bodian | 248/344 |
| 2,756,760 | 7/1956 | Grotteria | 135/20 A |
| 2,767,723 | 10/1956 | Sears, Jr. | 135/21 |
| 2,984,249 | 5/1961 | Sear, Jr. et al. | 135/90 |
| 4,674,523 | 6/1987 | Glatz | 135/21 |
| 4,697,777 | 10/1987 | Yang | 248/343 |
| 4,894,754 | 1/1990 | Levilain | 248/288.3 X |

FOREIGN PATENT DOCUMENTS

| | | | |
|---|---|---|---|
| 3440493 | 2/1987 | Fed. Rep. of Germany . | |
| 1151258 | 1/1958 | France | 135/20 A |
| 192335 | 11/1964 | Sweden | 135/20 A |

*Primary Examiner*—David A. Scherbel
*Assistant Examiner*—Lan Mai
*Attorney, Agent, or Firm*—Peter K. Kontler

[57] ABSTRACT

The frame for a collapsible canopy is suspended on an externally threaded shaft which extends downwardly from a head in a concave socket at the free end of an overhead supporting arm. A nut which mates with the shaft beneath the frame can be rotated by way of a downwardly extending handle to move the frame into frictional engagement with the underside of the socket while urging the head against the upper side of the socket. If the angular position of the frame is to be changed, or if the frame is to be separated from the arm, the grip of the head and frame upon the socket is relaxed and the shaft is then ready to be withdrawn from an open slot of the socket.

20 Claims, 2 Drawing Sheets

UMBRELLA WITH SUSPENDED CANOPY

BACKGROUND OF THE INVENTION

The invention relates to umbrellas in general, and more particularly to improvements in umbrellas of the type wherein the collapsible canopy is suspended on a support.

A drawback of conventional umbrellas with a suspended canopy is that the wind is likely to sway and set in rotary motion the frame which carries the canopy as soon as the connection between the frame and the overhead support is relaxed. As a rule, the connection includes a joint which permits the canopy and its frame to turn and to thereby enable the canopy to descend as soon as the connection between the frame and the overhead support is relaxed. Extensive rotation of the frame with reference to the support can result in complete separation of the frame and canopy from the support so that the canopy descends toward or onto the ground. This can cause damage and/or injuries if the canopy is spread out above a table in an outdoor restaurant, above an outdoor food, fruit, flower or other stand or above a beach chair.

German Pat. No. 34 40 493 discloses an umbrella wherein a spherical joint which is directly carried by the overhead support is non-separably connected with the canopy-carrying frame. Such connection prevents total separation of the frame and canopy from the support; however, the connection also prevents convenient intentional detachment of the frame and canopy from the support, e.g., for overnight storage or in anticipation of heavy rains or strong winds. If the connection between the overhead support and the canopy carrying frame is located at a considerable distance from the ground, the person in charge of detaching the frame must resort to a chair, to a ladder or another implement which enables such person to reach and disengage the connection. The same procedure must be carried out in reverse when the frame is to be reattached to the overhead support.

In accordance with another prior proposal, the canopy carrying frame is mounted on an externally threaded spindle extending into a nut which is rigid with the spherical joint on the overhead support. The joint includes a socket and a spherical head in the socket. The latter is provided with a slot which receives an extension of the spherical head and thus permits attachment of the head to, or its detachment from, the socket. Separation of the head from the socket is possible only when the spindle is rotated relative to the nut to an extent which is necessary to move the frame to a position at a considerable distance from the spherical joint so that the head can be lifted above and its extension can be slipped out of the slot of the socket. A person standing beneath the frame and attempting to rotate the spindle with reference to the nut cannot observe the nut, i.e., such person cannot ascertain whether or not the spindle actually rotates relative to the nut in a direction to lower the frame and ultimately permit separation of the spherical head and its extension from the socket. If such person fails to terminate in time rotation of the spindle relative to the nut, the spindle becomes completely separated from the nut and the frame with the canopy is free to descend by gravity. This can result in damage to the frame and/or canopy as well as in injuries and in damage to the objects beneath the umbrella. Return movement of the frame and canopy to their operative positions is equally cumbersome. If a safety device is provided, such device must be actuated by hand prior to separation of the frame from the joint and again subsequent to reattachment of the frame.

OBJECTS OF THE INVENTION

An object of the invention is to provide a novel and improved coupling between the overhead support and the canopy carrying frame of an umbrella.

Another object of the invention is to provide a coupling which is simpler, more compact and easier to manipulate than heretofore known couplings.

A further object of the invention is to provide a novel and improved frame for the canopy of the above outlined umbrella.

An additional object of the invention is to provide a coupling which permits reliable retention of the canopy in any one of a practically infinite number of different positions with reference to the overhead support.

Still another object of the invention is to provide an umbrella wherein relatively minor movements of the frame with reference to the overhead support suffice to permit detachment of the frame from the support or reliable retention of the frame and canopy in a selected orientation with reference to the support.

A further object of the invention is to provide a novel and improved method of preventing unintentional complete detachment of the frame from the support.

Another object of the invention is to provide a novel and improved overhead support for the frame of the above outlined umbrella.

SUMMARY OF THE INVENTION

The invention is embodied in an umbrella which comprises a support (such as an elongated substantially horizontal arm), a canopy-carrying frame, and a separable coupling between the frame and the support. The coupling comprises a socket on the support, a head which overlies the socket and has a portion extending downwardly through the socket and carrying the frame, and means for moving the frame against the socket so that the socket is releasably clamped between the head and the frame. The socket can be provided with an open-ended slot through which the aforementioned portion of the head extends and which enables such portion of the head to move between a first position in which the head overlies the socket and a second position in which the head and its portion are disengaged from the socket. The socket can be provided with a convex underside, and the frame can be provided with a concave upper side which is adjacent and can frictionally engage the convex underside of the socket when the socket is clamped between the head and the frame.

The aforementioned portion of the head preferably includes or constitutes an externally threaded shaft, and the moving means then includes a nut which mates with the shaft and is rotatable relative to the shaft to thereby move the frame upwardly against the socket or to permit or cause the frame to descend and become disengaged from the socket. The socket can include two prongs which flank the open-ended slot, and the frame can be provided with a passage for the shaft. The nut of such coupling is located, at least in part, beneath the passage in the frame.

The umbrella can further comprise means for movably but non-separably connecting the shaft and the frame to each other, preferably in such a way that the shaft and the frame can move axially but cannot rotate relative to each other. Still further, the umbrella can comprise resilient means (such as one or more coil springs) operating between the head and the frame to urge the head away from the frame in the axial direction of the shaft. The frame preferably includes a sleeve which defines the axial passage for the shaft at a level above the nut.

The frame can further include at least one ring and ribs which radiate from the at least one ring. The nut is rotatable relative to the at least one ring and includes an entraining portion which is operative to move the at least one ring axially of the shaft in response to rotation of the nut with reference to the shaft and the at least one ring. The nut can be provided with a tapped bore with an open upper end which receives the externally threaded shaft. The lower end of the nut can constitute or resemble a handle which includes the aforementioned entraining portion and facilitates rotation of the nut. The at least one ring of the frame can include a muff which surrounds a portion of the nut and abuts the entraining means. The nut and/or the at least one ring includes means for holding the muff against movement away from the entraining means.

One end portion of the nut is preferably telescoped into the lower end portion of the sleeve or vice versa. The aforementioned connecting means is designed to limit the extent of axial movability of the sleeve and the shaft relative to each other. Such connecting or limiting means can comprise at least one male detent member and a complementary female detent member. One of these detent members is provided in the sleeve of the frame, and the other detent member is provided on the shaft. Such detent members prevent rotation of the sleeve and the shaft relative to each other.

The frame can further comprise a second ring which is provided on the sleeve and second ribs which radiate from the second ring. The collapsible canopy of the umbrella is carried by the ribs, particularly by the second ribs. The nut is rotatable relative to the shaft and relative to the rings and sleeve of the frame.

The novel features which are considered as characteristic of the invention are set forth in particular in the appended claims. The improved umbrella itself, both as to its construction and the mode of assembling, dismantling and operating the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
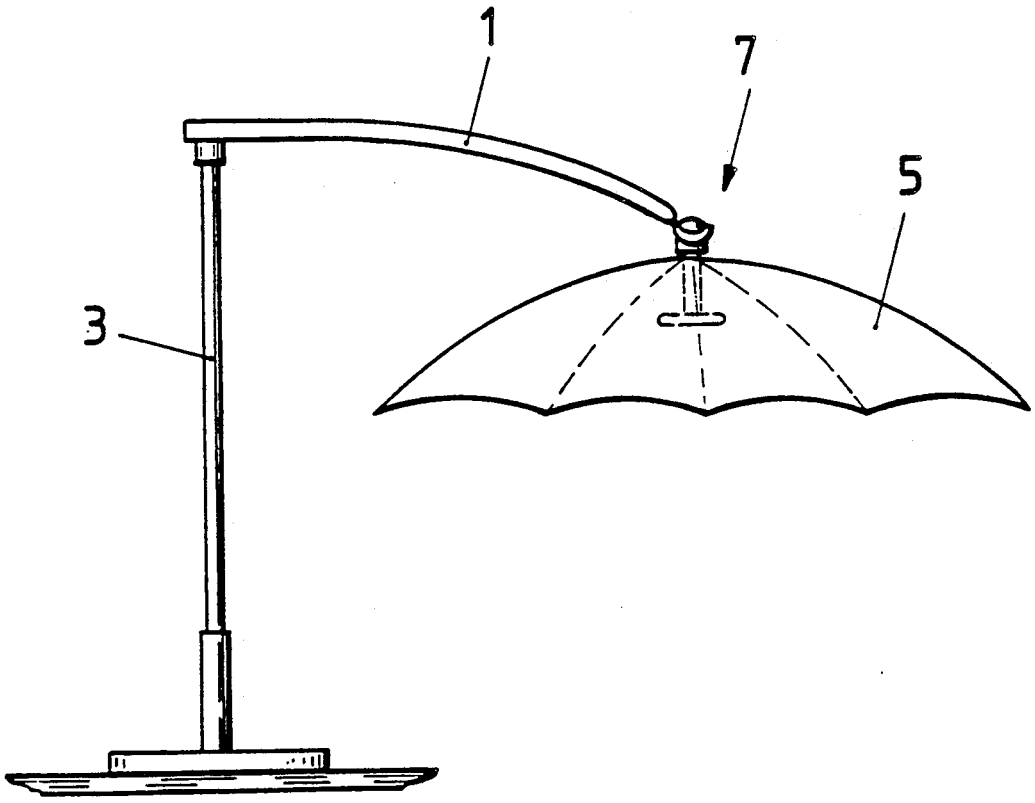
FIG. 1 schematic elevational view of an umbrella which embodies one form of the invention, with the frame rigidly secured to the overhead support.
Figure 2:
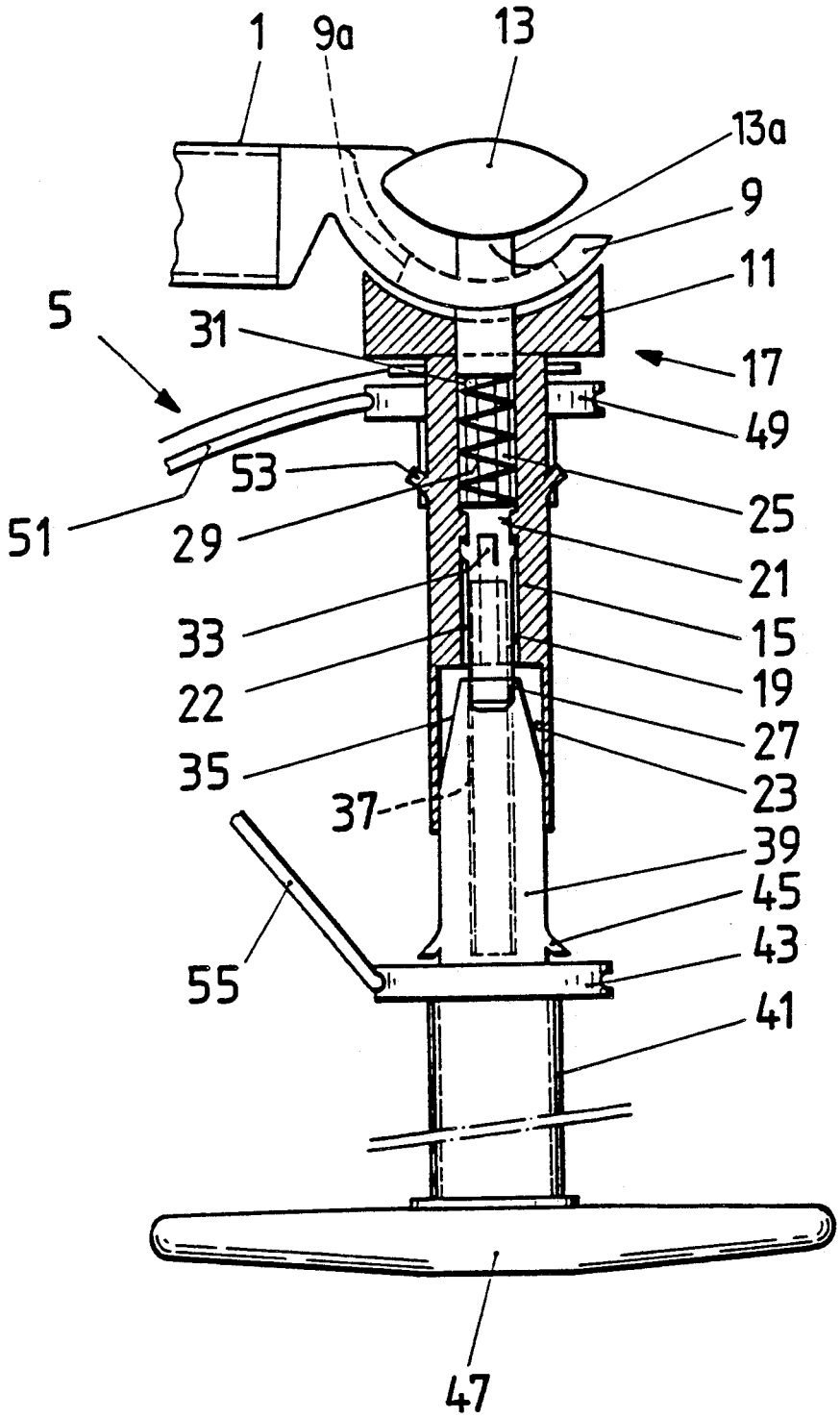
FIG. 2 an enlarged axial sectional view of the coupling between the frame which carries the collapsible canopy and the free end portion of the overhead support.

FIG. 1 shows an upright column 3 which carries an elongated support 1 in the form of an arm. The free end of the arm 1 mounts the frame 17 (FIG. 2) for a collapsible canopy 5 which is made of a textile or other suitable material, and the frame 17 is separably connected to the arm 1 by a coupling 7. The details of the frame 17 and coupling 7 are shown in FIG. 2. The support or arm 1 can be anchored in a wall or the like, i.e., the column 3 can be omitted. The spread-out or expanded canopy 5 can be disposed above a table in an outdoor restaurant, above a stand in an outdoor market, above one or more beach chairs or above any other object or objects which are to be shielded from sun and/or rain.

As can be seen in FIG. 2, the coupling 7 includes a claw-shaped socket 9 which has a concave upper side and a convex underside. The socket 9 is provided with an open-ended slot 9*a* which extends between two prongs and normally receives a shank-shaped portion (hereinafter called shank) 13*a* of a substantially spherical or lentil-shaped head 13 constituting another component of the coupling 7 and being integral with an elongated externally threaded shaft 25. The socket 9 can constitute a sector of a hollow sphere extending along an arc of between 90° and 270°, preferably between 120° and 240°. This socket can constitute an integral or a detachable part of the support 1. The concave upper side of the socket 9 can be frictionally engaged by the adjacent convex underside of the head 13, and the convex underside of the socket can be frictionally engaged by the concave upper side of an enlarged upper end portion 11 of the frame 17 when the latter is caused to assume the upper end position of FIG. 1 in which the socket 9 is clamped between the frame 17 (from below) and by the head 13 (from above).

The upper end portion 11 is integral or separably but preferably rigidly connected with a sleeve 15 of the frame 17, and the sleeve 15 is formed with an axial through passage 19 for the shaft 25. The frame 17 further includes an upper ring 49 with a set of suitably arched ribs 51 (only one can be seen in FIG. 2) which carry the canopy 5. An intermediate portion of the passage 19 in the sleeve 15 accommodates a circumferentially complete internal rib 21 which is disposed at a level above one or more axially parallel internal grooves 22 of the sleeve 15. Such grooves constitute female detent members and receive portions of male detent members 33 in the form of upwardly and outwardly extending lugs on the shaft 25. The surfaces bounding the grooves 22 and the lugs 33 cooperate to perform a plurality of important functions including holding the shaft 25 and the sleeve 15 against angular movement relative to each other while permitting the shaft 25 to move axially with reference to the sleeve and/or vice versa. Moreover, the surfaces bounding the grooves 22 cooperate with the male detent members 33 to non-separably connect the shaft 25 and the sleeve 15 to each other as well as to limit the extent of axial movability of the parts 15, 25 relative to one another.

The lower end portion of the passage 19 is enlarged, as at 23, to receive the frustoconical upper end portion 35 of a nut 39; the latter forms part of a means for moving the upper end portion 11 of the sleeve 15 against or away from the underside of the socket 9. The nut 39 is located at a level beneath the smaller-diameter upper portion of the axial passage 19 in the sleeve 15. This nut has a tapped bore or hole 37 with an internal thread which mates with the external thread on the lower end portion 27 of the shaft 25. The latter extends into the upper end of the tapped bore 37.

The diameter of the upper portion of the shaft 25 corresponds to the diameter of the passage 19 in the upper end portion 11 of the sleeve 15, and the diameter of the adjacent median portion of the shaft 25 is reduced so that it can axially movably extend through the internal rib 21 of the sleeve 15. A coil spring 29 or analogous resilient element 29 is installed in the sleeve 15 to urge the shaft 25 upwardly. To this end, the lowermost convolution of the spring 29 reacts against the upper side of the internal rib 21 of the sleeve 15, and the uppermost convolution of this spring bears against an annular shoulder or retainer 31 of the shaft 25. Thus, the spring 29 tends to move the head 13 and the upper end portion 11 of the sleeve 15 axially of the shaft 25 and away from each other.

In addition to or in lieu of the surfaces bounding the grooves 22 and the male detent members 33, the shaft 25 and the sleeve 15 can be held against rotation relative to each other by one or more radial screws (not shown) which extend through tapped bores of the sleeve 15 and have tips extending into axially parallel peripheral grooves or flutes of the shaft 25. The male detent members 33 cooperate with the surfaces bounding the respective grooves 22 of the sleeve 15 to limit the axial movements of the shaft 25 and the sleeve relative to each other in such a way that the spring 29 is free to move the head 13 and the upper end portion 11 of the sleeve 15 apart to an extent which is necessary to enable an operator to move the shank 13*a* to the right and out of the slot 9*a* of the socket 9 if the frame 17 is to be completely separated from the support 1, or to conveniently reinsert the shank 13*a* into the slot 9*a*.

The lower end portion of the sleeve 15 (this lower end portion surrounds the larger-diameter portion 23 of the passage 19) cooperates with the substantially frustoconical upper end portion 35 of the nut 39 to center the nut with reference to the sleeve 15 while the tapped bore 37 of the nut receives the externally threaded lower end portion 27 of the shaft 25. The nut 39 carries a lower ring 43 which can be said to form part of the frame 17 and supports radially extending ribs 55 (only one shown in FIG. 2) of the frame 17. The lower ring 43 is preferably rigid with a cylindrical portion or muff 41 which surrounds an extension of the nut 39 and rests on an entraining portion 47 in the form of a handle serving as a means for rotating the nut 39 relative to the shaft 25. The nut 39 further includes one or more downwardly and outwardly extending projections in the form of lugs 45 which hold the lower ring 43 against movement upwardly and away from the handle 47. The ring 43 can form an integral part of the muff 41. The latter can be slipped onto the nut 39 when the nut is detached from the shaft 25. The muff 41 is then moved onto the nut 39 so that it pushes the depressible lug or lugs 45 inwardly. When the muff 41 reaches the handle 47, the lug or lugs 45 are free to reassume the positions which are shown in FIG. 2 and thus prevent unintentional separation of the nut and muff (and ring 43) from each other. The mounting of the ring 43 on the nut 39 is preferably such that the muff 41 is installed with a certain axial play between the handle 47 and the lugs 45.

FIG. 2 further shows outwardly and upwardly extending lugs 53 which are provided at the exterior of the sleeve 15 and limit the extent of movability of the upper ring 49 away from the upper end portion 11 of the sleeve 15.

When the shank 13*a* of the head 13 is remote from the slot 9*a* of the socket 9, the spring 29 maintains the head 13 and the upper end portion 11 of the sleeve 15 at a preselected distance from each other so that the shank 13*a* can be readily inserted into the slot 9*a*. The head 13 comes to rest on the prongs or claws of the socket 9. The canopy 5 of the umbrella is in collapsed condition when the nut 39 is separated from the externally threaded lower end portion 27 of the shaft 25. The lower ring 43 and its ribs 55 then serve as a means for preventing complete separation of the nut 39 and its handle 47 from the frame 17 because the muff 41 of the ring 43 is confined between the handle 47 and the lugs 45.

If an operator thereupon desires to expand or spread out the canopy 5 and to fix the frame 17 to the socket 9 in a selected angular position of the shaft 25, the conical upper end portion 35 of the nut 39 is inserted into the enlarged portion 23 of the axial passage 19 to mesh with the lower end portion 27 of the shaft 25. The upper portion of the nut 39 cooperates with the lower portion of the sleeve 15 to automatically align the nut with the shaft 25 and to facilitate penetration of the lower end portion 27 into the tapped bore 37 as a result of rotation of the handle 47 in the proper direction. As the operator rotates the handle 47 in such direction, the nut 39 draws the shaft 25 toward the handle so that the spring 29 is caused to store energy and the socket 9 is ultimately clamped between the head 13 and the upper end portion 11 of the sleeve 15. The canopy 5 is or can be at least partially opened as a result of insertion of the nut 39 into the enlarged lower portion 23 of the passage 19. The width of the slot 9*a* in the socket 9 can be selected in such a way that the parts 9 and 13 constitute a universal joint which enables the shaft 25 to change its inclination in any selected direction. The shaft 25 then remains in a selected position as soon as the socket 9 is clamped between the head 13 and the upper end portion 11 of the sleeve 15. Expansion of the canopy 5 can continue while the nut 39 draws the shaft 25 into the tapped bore 37, i.e., while the distance between the head 13 and the upper end portion 11 of the sleeve 15 decreases. If the orientation of the canopy 25 relative to the support 1 is to be changed, the handle 47 is caused to rotate the nut 39 in a direction to terminate the clamping engagement between the head 13 and sleeve 15 on the one hand, and the socket 9 on the other hand, so that the inclination of the shaft 25 can be changed before the parts 11 and 13 are returned into requisite frictional engagement with the respective sides of the socket 9. If the shank 13*a* is to be extracted from the slot 9*a*, the nut 39 is preferably separated from the shaft 25 so that the spring 29 is free to maintain the head 13 and the sleeve 15 (i.e., the upper end portion 11 of the sleeve 15) at an optimum distance from each other so as to enable the operator to lift the head 13 out of the depression in the upper side of the socket 9 while drawing the shank 13*a* out of the slot 9*a*.

Mounting of the shaft 25 in the frame 17 is a simple operation which can be carried out without resorting to any tools. All that is necessary is to slip the coil spring 29 onto the shaft 25 so that the spring abuts the shoulder 31, and the externally threaded end portion 27 of the shaft 25 is then caused to pass into the smaller-diameter portion of the axial passage 19. The spring 29 engages the internal rib 21 of the sleeve 15, and the male detent member or members 33 cooperate with the surfaces bounding the internal grooves (female detent members) 22 of the sleeve 15 to prevent accidental extraction of the shaft 25 from the frame 17 and to maintain the spring 29 in stressed condition. It will be seen that insertion of the shaft 25 into the sleeve 15 is analogous to insertion of the nut 39 into the muff 41 of the lower ring 43 except that it is not necessary to bias the nut 39 and the muff 41 axially of each other.

An advantage of the improved umbrella is its simplicity. Moreover, the canopy 5 cannot become accidentally separated from the support 1. Still further, the male component 13, 13*a* of the coupling 7 can be readily attached to or detached from the female component 9, and the canopy 5 can be maintained in a selected orientation with a requisite force by the simple expedient of causing the head 13 and the upper end portion 11 of the sleeve 15 to frictionally engage the respective sides of the socket 9. The surfaces of the socket 9 and/or head 13 and/or upper end portion 11 can be roughened to enhance the frictional engagement when the canopy 5 is to be maintained in a selected position. The distance of the handle 47 from the ground can be selected in such a way that the handle can be reached and rotated by a person standing on the ground, i.e., without the need for a ladder or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An umbrella comprising a support; a canopy-carrying frame having a clamping section; and a separable coupling between said frame and said support, said coupling comprising a socket on said support and a head having a portion extending through said socket and carrying said frame, said head and said section flanking said socket, and said coupling further comprising moving means for releasably clamping said socket between said head and said section.

2. The umbrella of claim 1, wherein said socket has an open-ended slot through which said portion of said head is movable between a first position in which said head overlies said socket and a second position in which said head and said portion thereof are disengaged from said socket.

3. The umbrella of claim 2, wherein said socket has a convex underside and said section has a concave upper side which is adjacent said underside when said socket is clamped between said head and said section.

4. The umbrella of claim 3, wherein said portion of said head includes an externally threaded shaft and said moving means includes a nut mating with shaft, and being rotatable relative to said shaft to thereby move said section upwardly against said socket or to permit said section to descend and become disengaged from said socket.

5. The umbrella of claim 4, further comprising means for movably but non-separably connecting said frame and said shaft to each other.

6. The umbrella of claim 4, further comprising means for non-rotatably and axially movably connecting said shaft and said frame to each other.

7. The umbrella of claim 4, wherein said frame includes a sleeve having an axial passage for said shaft, at least a portion of said nut being located beneath said sleeve.

8. The umbrella of claim 4, wherein said frame includes a sleeve having an axial passage for said shaft and at least a portion of said nut is located beneath said sleeve, said nut and said sleeve having end portions one of which is axially telescoped into the other to center said sleeve and said nut relative to one another.

9. The umbrella of claim 4, wherein said frame includes a sleeve having an axial passage for said shaft and at least a portion of said nut is located beneath said sleeve, said sleeve and said shaft being axially movable with reference to each other; and further comprising means for limiting the extent of axial movability of said sleeve and said shaft relative to each other.

10. The umbrella of claim 4, wherein said frame includes a sleeve having a passage for said shaft and at least a portion of said nut is located beneath said sleeve, said sleeve and said shaft being axially movable relative to each other; and further comprising means for preventing rotation of said shaft and said sleeve relative to each other.

11. The umbrella of claim 4, wherein said frame includes a sleeve having an axial passage for said shaft, a first ring on said sleeve, a second ring carried by said nut, first ribs radiating from said first ring and second ribs radiating from said second ring; and further comprising a collapsible canopy carried by said ribs first at least a portion of said nut being located beneath said sleeve and being rotatable with reference to said sleeve and said rings.

12. The umbrella of claim 1, wherein said coupling is designed to permit rotation of said frame relative to said support when said socket is released.

13. An umbrella comprising a support; a canopy-carrying frame; and a separable coupling between said frame end and said support, said coupling comprising a socket on said support, a head overlying said socket and having a portion extending downwardly through said socket and carrying said frame, and means for moving said frame against said socket so that the socket is releasably clamped between said head and said frame, said socket having a convex underside and said frame having a concave upper side which is adjacent said underside when said socket is clamped between said head and said frame, said socket also having an open-ended slot through which said portion of said head is movable between a first position in which said head overlies said socket and a second position in which said head and said portion thereof are disengaged from said socket, said portion of said head including an externally threaded shaft, and said moving means including a nut mating with, and being rotatable relative to, said shaft to thereby move said frame upwardly against said socket or to permit said frame to descend and become disengaged from said socket, said socket further having two prongs flanking said slot, and said frame having a passage for said shaft, at least a portion of said nut being located beneath said passage.

14. An umbrella comprising a support; a canopy-carrying frame; a separable coupling between said frame and said support, said coupling comprising a socket on said support, a head overlying said socket and having a portion extending downwardly through said socket and carrying said frame, and means for moving said frame against said socket so that the socket is releasably clamped between said head and said frame, said socket having a convex underside and said frame having a concave upper side which is adjacent said underside when said socket is clamped between said head and said frame, said socket also having an open-ended slot through which said portion of said head is movable between a first position in which said head overlies said socket and a second position in which said head and said portion thereof are disengaged from said socket, said portion of said head including an externally threaded shaft, and said moving means including a net mating with, and being rotatable relative to, said shaft to thereby move said frame upwardly against said socket or to permit said frame to descend and become disengaged from said socket; means for non-rotatably and axially movably connecting said shaft and said frame to each other; and resilient means operating between said head and said frame to urge said head away from said frame in the axial direction of said shaft.

15. An umbrella comprising a support; a canopy-carrying frame; and a separable coupling between said frame and said support, said coupling comprising a socket on said support, a head overlying said socket and having a portion extending downwardly through said socket and carrying said frame, and means for moving said frame against said socket so that the socket is releasably clamped between said head and said frame, said socket having a convex underside and said frame having a concave upper side which is adjacent said underside when said socket is clamped between said head and said frame, said socket also having an open-ended slot through which said portion of said head is movable between a first position in which said head overlies said socket and a second position in which said head and said portion thereof are disengaged from said socket, said portion of said head including an externally threaded shaft, and said moving means including a nut mating with, and being rotatable relative to, said shaft to thereby move said frame upwardly against said socket or to permit said frame to descend and become disengaged from said socket, said frame including at least one ring and ribs radiating from said at least one ring, and said nut being rotatable relative to said at least one ring and including an entraining portion operative to move said at least one ring axially of said shaft in response to rotation of said nut with reference to said shaft and said at least one ring.

16. The umbrella of claim 15, wherein said nut has a tapped bore with an open upper end which receives said shaft, said nut further having a lower end constituting a handle which facilitates rotation of said nut and includes said entraining portion.

17. The umbrella of claim 16, wherein said at least one ring includes a muff which surrounds a portion of said nut and abuts said entraining portion.

18. The umbrella of claim 17, further comprising means for holding said muff against movement away from said entraining portion.

19. An umbrella comprising a support; a canopy-carrying frame; a separable coupling between said frame and said support, said coupling comprising a socket on said support, a head overlying said socket and having a portion extending downwardly through said socket and carrying said frame, and means for moving said frame against said socket so that the socket is releasably clamped between said head and said frame, said socket having a convex underside and said frame having a concave upper side which is adjacent said underside when said socket is clamped between said head and said frame, said socket also having an open-ended slot through which said portion of said head is movable between a first position in which said head overlies said socket and a second position in which said head and said portion thereof are disengaged from said socket, said portion of said head including an externally threaded shaft, and said moving means included a nut mating with, and being rotatable relative to, said shaft to thereby move said frame upwardly against said socket or to permit said frame to descend and become disengaged from said socket, said frame including a sleeve having an axial passage for said shaft, and at least a portion of said nut being located beneath said sleeve, said sleeve and said shaft being axially movable with reference to each other; and means for limiting the extent of axial movability of said sleeve and said shaft relative to each other, said limiting means comprising at least one male detent member and a complementary female detent member, one of said detent members being provided in said sleeve and the other of said detent members being provided on said shaft.

20. An umbrella comprising a support; a canopy-carrying frame; a separable coupling between said frame and said support, said coupling comprising a socket on said support, a head overlying said socket and having a portion extending downwardly through said socket and carrying said frame, and means for moving said frame against said socket so that the socket is releasably clamped between said head and said frame, said socket having a convex underside and said frame having a concave upper side which is adjacent said underside when said socket is clamped between said head and said frame, said socket also having an open-ended slot through which said portion of said head is movable between a first position in which said head overlies said socket and a second position in which said head and said portion thereof are disengaged from said socket, said portion of said head including an externally threaded shaft, and said moving means including a nut mating with, and being rotatable relative to, said shaft to thereby move said frame upwardly against said socket or to permit said frame to descend and become disengaged from said socket, said frame including a sleeve having a passage for said shaft, and at least a portion of said nut being located beneath said sleeve, said sleeve and said shaft being axially movable relative to each other; and means for preventing rotation of said shaft and said sleeve relative to each other, said rotation preventing means comprising at least one male detent member and a complementary female detent member, one of said detent members being provided in said sleeve and the other of said detent members being provided on said shaft.

* * * * *